US009993681B2

(12) United States Patent
McCall, Jr.

(10) Patent No.: US 9,993,681 B2
(45) **Date of Patent: *Jun. 12, 2018**

(54) CORE TRAINING BENCH

(71) Applicant: Thomas D. McCall, Jr., Bakersfield, CA (US)

(72) Inventor: Thomas D. McCall, Jr., Bakersfield, CA (US)

( * ) Notice: Subject to any disclaimer, the term of this patent is extended or adjusted under 35 U.S.C. 154(b) by 231 days.

This patent is subject to a terminal disclaimer.

(21) Appl. No.: 13/920,082

(22) Filed: Jun. 17, 2013

(65) Prior Publication Data

US 2017/0209735 A1 Jul. 27, 2017

(51) Int. Cl.

| | |
|---|---|
| ***A63B 21/00*** | (2006.01) |
| ***A63B 22/00*** | (2006.01) |
| ***A63B 21/055*** | (2006.01) |
| ***A63B 23/02*** | (2006.01) |
| ***A63B 23/12*** | (2006.01) |
| ***A63B 23/04*** | (2006.01) |

(52) U.S. Cl.

CPC ..... *A63B 22/0023* (2013.01); *A63B 21/0557* (2013.01); *A63B 21/4029* (2015.10); *A63B 21/4035* (2015.10); *A63B 22/0046* (2013.01); *A63B 23/0205* (2013.01); *A63B 23/04* (2013.01); *A63B 23/1227* (2013.01); *A63B 2225/093* (2013.01)

(58) Field of Classification Search

USPC ..... 482/140–142

See application file for complete search history.

(56) References Cited

U.S. PATENT DOCUMENTS 3,948,513 A * 4/1976 Pfotenhauer ..... A63B 17/04 482/142
4,546,967 A * 10/1985 Kecala ..... A63B 21/4031 482/102
4,653,751 A * 3/1987 Green ..... A63B 21/4029 482/104
4,927,139 A * 5/1990 Taltre ..... A63B 21/00047 482/142
4,936,572 A * 6/1990 Desiderio ..... A63B 21/4029 248/291.1
5,050,589 A * 9/1991 Engle ..... A61H 1/024 482/142
5,160,305 A * 11/1992 Lin ..... A63B 23/00 482/138

(Continued)

*Primary Examiner* — Stephen R Crow
(74) *Attorney, Agent, or Firm* — Richard A. Ryan

(57) ABSTRACT

An improved exercise bench for effectively and efficiently training the core portion of the user's body. The core training bench comprises a bench having an upper section and a separate lower section, a frame for supporting the bench above a surface, leg members interconnecting the frame and the bench and pivoting mechanisms interconnecting the leg members and the bench or the frame to allow the sections of the bench to pivot or tilt relative to the leg members. In the preferred embodiment, the upper section is able to pivot independent of the pivoting lower section so the user can place the bench in any one of a plurality of different tilt positions so he or she may selectively exercise different muscle groups at his or her core. The core training bench can include an oblique stand, grip bar, tension cable hooks and/or a removable section for an AB ball.

18 Claims, 10 Drawing Sheets

(56) References Cited

U.S. PATENT DOCUMENTS 5,163,890 A * 11/1992 Perry, Jr. ..... A63B 21/00047 482/142
5,354,251 A * 10/1994 Sleamaker ..... A63B 21/156 482/142
5,542,898 A * 8/1996 Wilkinson ..... A63B 21/0552 482/120
5,649,886 A * 7/1997 Danylieko ..... A63B 21/078 482/104
6,022,303 A * 2/2000 Abdo ..... A63B 23/0211 482/121
6,110,081 A 8/2000 Barrett
6,287,243 B1 * 9/2001 Isom ..... A63B 21/078 482/104
6,764,432 B2 * 7/2004 Hippensteel ..... A63B 23/03575 482/142
6,902,515 B2 * 6/2005 Howell ..... A63B 22/0012 482/57
6,966,872 B2 * 11/2005 Eschenbach ..... A63B 21/068 482/142
6,976,944 B1 * 12/2005 Damasio ..... A61H 1/0222 482/112
7,128,701 B1 * 10/2006 Ketcham ..... A63B 21/00047 482/142
7,204,790 B2 * 4/2007 Sleamaker ..... A63B 21/068 482/142
7,226,400 B1 6/2007 Gedeon-Janvier
7,285,077 B1 * 10/2007 Marx ..... A63B 21/06 482/104
7,331,913 B2 2/2008 Forcillo
8,118,715 B2 * 2/2012 Greene ..... A63B 22/203 482/57
8,235,878 B2 * 8/2012 Signorile ..... A63B 26/003 482/142
8,465,403 B2 * 6/2013 McCall, Jr. ..... A63B 23/0205 482/142
8,636,628 B1 * 1/2014 Greene ..... A63B 22/203 482/142
9,545,540 B1 * 1/2017 Moschel ..... A63B 22/0046
D785,732 S * 5/2017 Moschel ..... D21/690
2005/0079964 A1 * 4/2005 Francavilla ..... A63B 23/0233 482/142
2005/0143233 A1 * 6/2005 Shifferaw ..... A63B 21/023 482/140
2007/0129225 A1 * 6/2007 Hammer ..... A63B 21/0552 482/129
2010/0240506 A1 * 9/2010 Bohanan ..... A63B 21/068 482/142
2010/0280549 A1 * 11/2010 Yen ..... A61G 7/015 606/237

* cited by examiner

CORE TRAINING BENCH

CROSS-REFERENCE TO RELATED APPLICATIONS

This patent application is a continuation-in-part of U.S. patent application Ser. No. 12/854,074, which issued as U.S. Pat. No. 8,465,403 on Jun. 18, 2013, which claims priority to U.S. Provisional Application No. 61/232,787 filed Aug. 11, 2009.

STATEMENT REGARDING FEDERALLY SPONSORED RESEARCH

Not Applicable.

REFERENCE TO A SEQUENCE LISTING, A TABLE OR A COMPUTER PROGRAM LISTING APPENDIX SUBMITTED ON A COMPACT DISC

Not Applicable.

BACKGROUND OF THE INVENTION

A. Field of the Invention

The field of the present invention relates generally to equipment utilized for exercise and health improvement. In particular, the present invention relates to exercise equipment that is generally configured as a bench. Even more particularly, this invention relates to exercise benches that assist the user with exercising and strengthening the core portion of his or her body.

B. Background

Many people exercise to improve their health and fitness levels and as a method to control their weight or to lose weight. One common area of the body that many people desire to improve is commonly referred to as the core area of the body. The core area of the body is generally considered the area at or near the abdomen and lower back. The muscles in the core area are where movement originates and help keep the body stable and balanced. For many people, the core area of their body, and the abdomen in particular, is the part of their body that is most in need of improvement. Unfortunately, this area of the body is generally considered as being the most difficult area to apply exercise routines in a manner that effectively and efficiently improves the person's fitness and physique. With regard to exercises, the typical method of exercising the core area of the body is to perform conventional sit-ups, crunches and back bends. For most people, these exercises are uncomfortable and are difficult to perform properly and, therefore, are not done on a regular basis.

To assist with improving fitness and/or losing weight, many people utilize specially configured exercise equipment that allows the user to more effectively and efficiently target the area of their body they wish to improve. One such exercise equipment is the exercise bench. In the field of exercise equipment, the use of exercise benches to improve the effectiveness and efficiency of various exercise and fitness routines is well known. Many exercise benches are configured to be part of a larger array of weight lifting or exercise equipment. Generally, the large array type of exercise equipment is very expensive, somewhat massively sized and may not be necessarily efficient for directing exercises to specific areas of the body. Other benches are utilized for weight lifting. Generally, these benches have a support frame that is manufactured out of steel or other strong metals with a padded upper surface, often in the form of a removable pad, on which the user lays. Most of these benches are substantially flat. There are abdominal benches that are specifically configured to exercise the core area of the body by increasing the effectiveness of sit-ups, crunches and back bends. Typically, these benches are shorter than standard weight benches.

The presently available exercise benches have various limitations and/or disadvantages that prevent users from effectively and efficiently exercising the core area of their body. What is needed, therefore, is an improved exercise bench that is specifically configured to exercise the core area of the user's body. The improved exercise bench should more effectively and efficiently direct the user's exercises to improving the fitness of the core area of his or her body. In addition, the improved exercise bench should assist the user with his or her overall fitness and with controlling or losing weight by allowing the user to obtain a full body workout while using a limited amount of floor space. The improved exercise bench should be easy to use and made out of materials that are sufficiently durable and long lasting when used for exercise. Preferably, the improved exercise bench will be adjustable to allow users of different sizes to effectively and efficiently utilize the bench to exercise the core and other areas of the user's body. The improved exercise bench should also be able to transform into separate pieces of exercise equipment that allow the user to separately exercise different parts of his or her body.

SUMMARY OF THE INVENTION

The improved core training bench of the present invention provides the benefits and solves the problems identified above. That is to say, the present invention discloses an improved exercise bench which is specifically configured to allow the user to more effectively and efficiently exercise the core area of his or her body. The core train bench of the present invention also allows the user to obtain a full body workout while only requiring a limited amount of floor space. The core training bench of the present invention has two or more bench sections, with at least one of the bench sections being able to separately tilt to allow the user to more effectively and efficiently direct certain exercises to the core area of his or her body. As such, the core training bench will improve the user's overall fitness and assist the user with his or her desired weight control or weight loss objectives. The core training bench of the present invention is easy to utilize and is adjustable so as to accommodate users of different sizes. The core training bench can be made out of materials that provide a durable, long lasting exercise bench. In a preferred embodiment, the core training bench transforms into twelve separate pieces of gym quality exercise equipment that allow the user to separately exercise different parts of his or her body.

In one embodiment of the present invention, the core training bench generally comprises a bench made up of an upper section generally toward a head end of the core training bench and a lower section generally toward a foot end thereof, a frame that supports the core training bench above a surface such as a floor or the like, at least one first leg member and at least one second leg member that interconnect the frame and the upper section, a lower leg member that interconnects the frame and the lower section and a first pivoting mechanism which pivotally interconnects the lower leg member and the lower section to allow the lower section to pivot or tilt in relation to the lower leg member and the upper section. In the preferred embodiment, the core training bench also comprises a second pivoting mechanism interconnecting the first leg member with the upper bench and/or the frame and interconnecting the second leg member with the upper bench and/or the frame so the upper section can pivot independent of the lower section and the first and second leg members. With both the upper section and lower section able to tilt independently of each other, the bench of the core training bench can be placed in any one of a plurality of different tilt positions so the user can more effectively and efficiently exercise the different muscle groups that make up his or her core. In the preferred embodiment, each of the first leg member, second leg member and lower leg member are telescopically configured so the user can adjust the height, independently, of the upper and lower sections. In a preferred embodiment, the second pivoting means comprises swivel hinges that interconnect the first leg member and the upper bench, the second leg member and the upper bench, the first leg member and the frame and the second leg member and the frame. The preferred core training bench also has an oblique stand removably attached to the frame generally at the foot end of the core training bench, a removable section in the upper section that is sized and configured to removably receive an AB ball therein, a plurality of tension cable hooks attached to the frame for use with rubber tension cables and a grip bar connected to the upper section generally at the head end of the core training bench.

In one of the primary embodiments of the present invention, the core training bench transforms into twelve separate pieces of gym quality exercise equipment that allow the user to separately exercise different parts of his or her body, namely a flat bench, incline bench press, decline bench press, military press, 180 degree leg raises, 45 degree oblique/back extensions, bar dips, preacher curls, bent leg abdominal board, calf raises, leg extensions and leg curl. The user can quickly and easily transform the core training bench to and between these various different exercise equipment.

Accordingly, the primary aspect of the present invention is to provide an improved exercise bench that has the advantages discussed above and which overcomes the various disadvantages and limitations associated with prior art exercise benches.

It is an important aspect of the present invention to provide an improved exercise bench that allows the user to more effectively and efficiently exercise the core area of his or her body.

It is also an important aspect of the present invention to provide an improved exercise bench that facilitates the user being able to exercise the core area of his or her body in a safe manner.

It is also an important aspect of the present invention is to provide a core training bench that allows the user to obtain a full body workout using limited amount of floor space so as to assist the user with improving his or her overall fitness level and physique and to assist the user weight loss or other desired body weight objectives.

It is also an important aspect of the present invention to provide an improved exercise bench that comprises two or more bench sections with at least one of the bench sections being able to tilt to allow the user to more effectively and efficiently exercise the core area of his or her body.

It is also an important aspect of the present invention to provide a core training bench that has at least an upper section and a lower section that are both configured to tilt independent of each other so the user may place the bench in positions that are most effective and efficient to exercise his or her core area.

Another important aspect of the present invention is to provide a core training bench that is easily and quickly transformed into a variety of different types of exercise equipment.

Yet another important aspect of the present invention is to provide a core training bench that is easy to use, adjustable to fit different sizes of users and made of materials that provide a durable, long-lasting exercise bench.

It is also an important aspect of the present invention is to provide a core training bench that allows the user to obtain a full body workout using limited amount of floor space so as to assist the user with improving his or her overall fitness level and physique and to assist the user weight loss or other desired body weight objectives.

The above and other aspects and advantages of the present invention are explained in greater detail by reference to the attached figures and the description of the preferred embodiment which follows. As set forth herein, the present invention resides in the novel features of form, construction, mode of operation and combination of the above presently described and understood by the claims.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, the preferred embodiments of the present invention are set forth below. The enclosed text and drawings are merely illustrative of one or more preferred embodiments and, as such, disclose one or more different ways of configuring the present invention. Although specific components, materials, configurations and uses are illustrated, it should be understood that a number of variations to the components and to the configuration of those components described herein and in the accompanying figures can be made without changing the scope and function of the invention set forth herein. For instance, although the figures and description provided herein show certain shapes and configurations for the core training bench and its components, those skilled in the art will generally understand that this is merely for purposes of simplifying this disclosure and that the present invention is not so limited.

Figure 1:
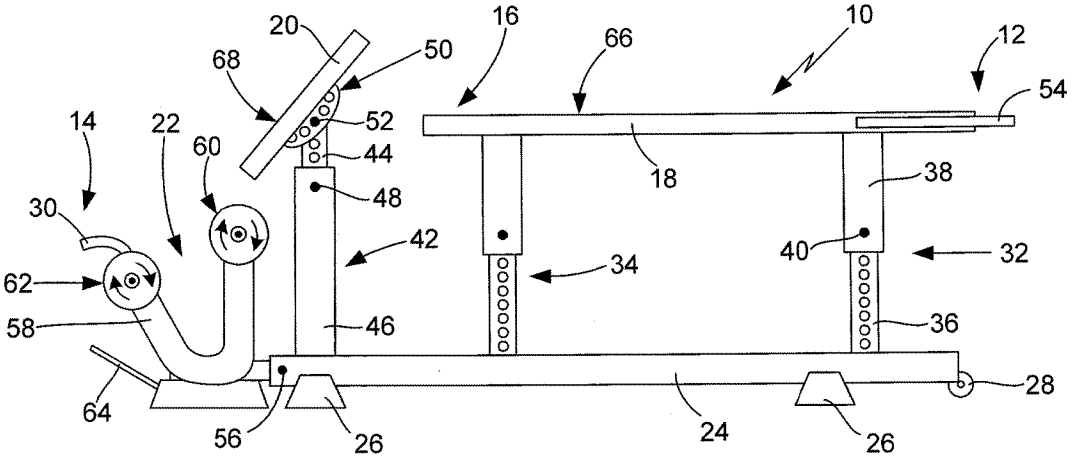
FIG. 1 is a side view of a core training bench configured according to a first embodiment of the present invention shown with the lower or second bench section of the core training bench in its inclined position.
Figure 2:
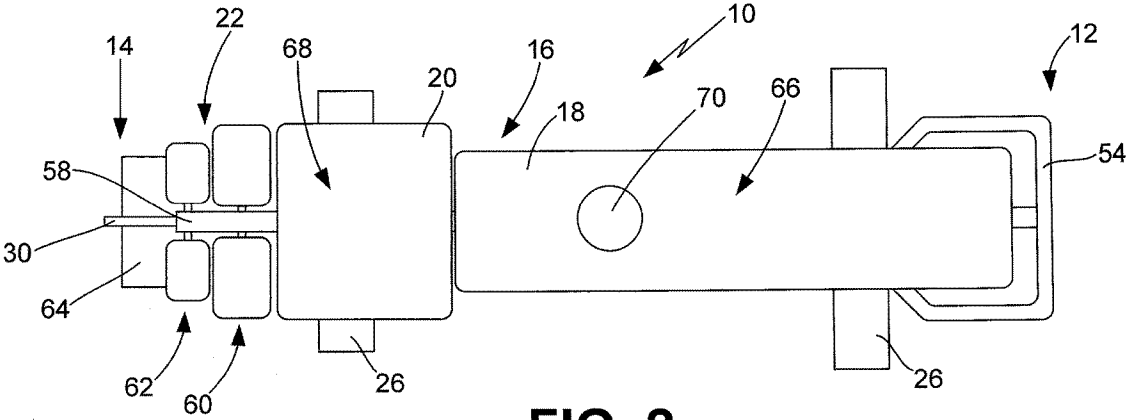
FIG. 2 is a top view of the core training bench of FIG. 1 shown with the lower or second bench section in its flat position.

A core training bench that is configured pursuant to one or more of the preferred embodiments of the present invention is shown generally as 10 in FIGS. 1-6 and 10-12. The core training bench 10 of the present invention has a first or head end 12 and a second or foot end 14, as best shown in FIGS. 1, 2, 5 and 6, which respectively refers to the position of the user's head and feet when he or she is laying down on the bench 16. The bench 16 has an upper or first bench section 18 and a lower or second bench section 20 that can be adjusted, both in their tilt angle and height, independently of each other (with the terms "upper" and "lower" being associated with the user's body as he or she lies on bench 16). In the embodiment of FIGS. 1 and 2, lower section 20 can be inclined relative to the fixed horizontal upper section 18 (as best shown in FIG. 1) or the lower section 20 can be placed in a generally horizontal relationship with the upper section 18 (FIG. 2), depending on the user's exercises and exercise objectives. In the embodiment of FIGS. 5, 6 and 7*a* through 7*d*, which is the preferred embodiment, both the upper 18 and lower 20 sections can be inclined to achieve the user's exercises and exercise objectives. As shown in FIGS. 7*a* through 7*d*, the upper 18 and lower 20 sections can be tilted independently of each other to obtain various relative inclined positions for the two sections 18/20. In addition, as described below, preferably both upper section 18 and lower section 20 of bench 16 are adjustable in height. At the foot end 14 of core training bench 10 is an oblique stand 22 which, in the preferred embodiment, is removably attached to portion of core training bench 10 having bench 16.

Figure 3:
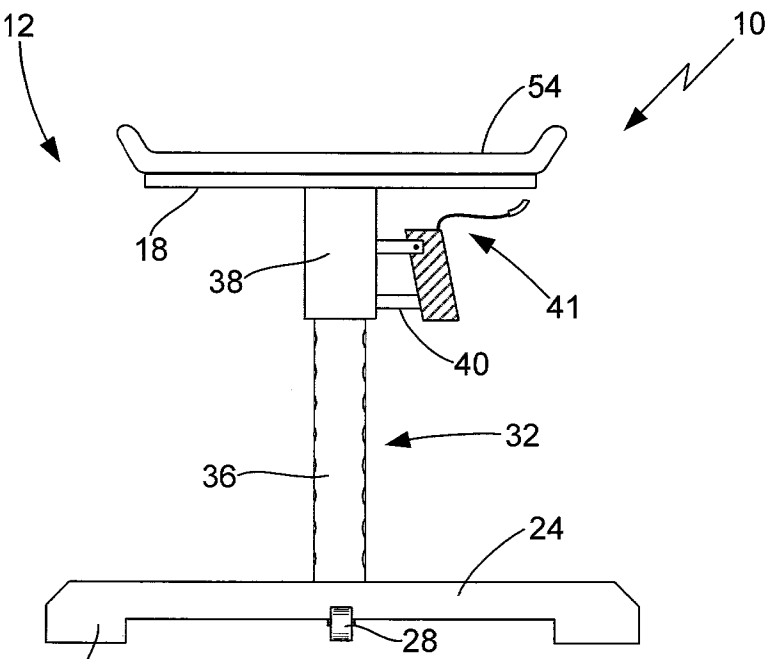
FIG. 3 is an end view of the head or first end of the core training bench of FIG. 2.
Figure 5:
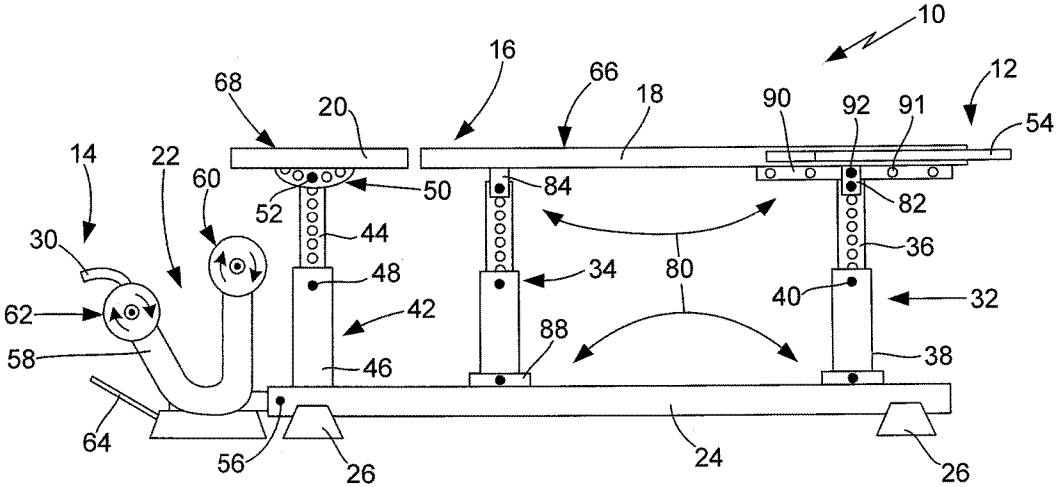
FIG. 5 is a side view of a core training bench configured according to a second embodiment of the present invention showing use of a removable section that is sized and configured to receive an AB ball.

As best shown in FIGS. 1 and 5, core training bench 10 has a frame 24 that is supported above the ground (though usually only a slight amount) on a plurality of base members 26 that are attached to frame 24. To assist the user with moving the core training bench 10, one or more mobility wheels 28 can be rotatably connected to the frame 24 at or near the head end 12 of core training bench 10 and a handle 30 is provided at or near its foot end 14 (which is shown attached to the oblique stand 22). Interconnecting frame 24 and the upper section 18 of bench 16 are one or more upper section leg members, typically comprising a first leg member 32 towards the head end 12 of core training bench 10, as shown in FIGS. 1, 3 and 5, and a second leg member 34 at the opposite end of the upper section 18 of bench 16, as shown in FIGS. 1 and 5. First 32 and second 34 leg members extend generally upward from frame 24 to support the upper section 18 of bench 16 above and in spaced apart relation to the frame 24, as shown in FIGS. 1 and 5. In the preferred embodiment, first 32 and second 34 leg members are configured to be adjustable in height so the user can adjust the height of the upper section 18 above frame 24. As well known in the art, a preferred mechanism to make the leg members 32/34 adjustable is to have them telescopically configured with a first leg section 36, typically having a plurality of apertures along its length, that is slidably received inside a second leg section 38, typically having a single aperture, and a connecting pin 40 that is received through the aperture of second leg section 38 and a set of apertures of first leg section 36 to fix the length of leg sections 36/38 relative to each other and set the height of upper section 18. As will be readily apparent to those skilled in the art, the insert/receiver relationship of the first 36 and second 38 leg sections can be reversed, as illustrated with regard to FIGS. 1 and 5, with the configuration of FIG. 5 generally being the preferred embodiment for strength, stability and safety purposes. If desired, core training bench 10 can be provided with a pin height adjusting mechanism 41, as shown in FIG. 3, that connects to pin 30 and is utilized by the user to selectively adjust the height of leg members 32/34 and, therefore, the height of upper section 18 of bench 16.

Figure 4:
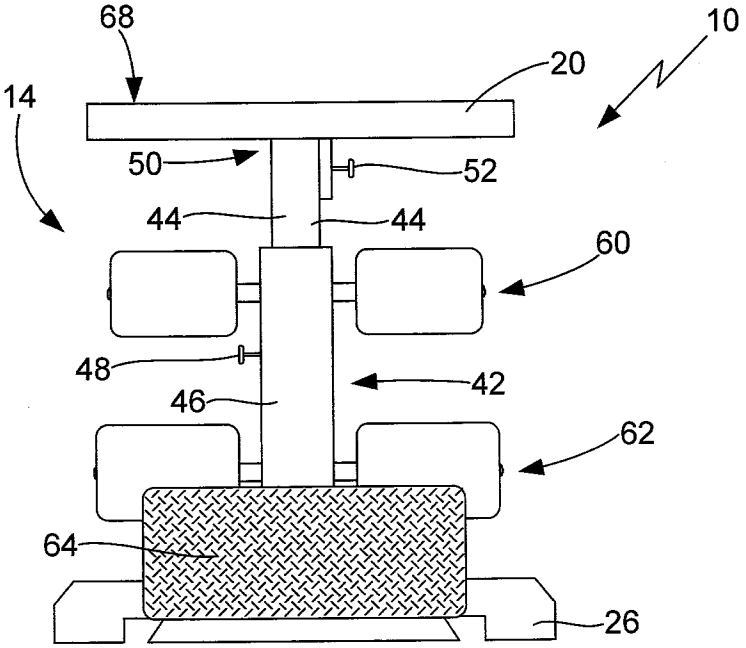
FIG. 4 is an end view of the foot or second end of the core training bench of FIG. 2.

As stated above, in the embodiment of core training bench 10 of the present invention shown in FIGS. 1 and 2, bench 16 has a separate lower section 20 that can be raised, lowered and tilted relative to the upper section 18, which is configured in this embodiment to remain generally horizontal. The lower section 20 has one or more separate lower leg members 42 that are connected to frame 24 to support the lower section 20 above and in spaced apart relation to frame 24. In a preferred configuration for the embodiment of FIG. 1, there is a single lower leg member 42 (as best shown in FIG. 4) and it is adjustable in height by being telescopically configured with a first leg section 44, having a plurality of apertures along its length, that is slidably received in a second leg section 46, having a single aperture, with a connecting pin 48 utilized to fix the height of lower section 20 by being received through the aperture of the second leg section 46 and one set of apertures in first leg section 44. A first pivoting mechanism 50 positioned at the upper end of the lower leg member 42 interconnects the lower leg member 42 and lower section 20 of bench 16. First pivoting mechanism 50 should be configured to allow the user to easily and quickly adjust the degree of tilt for lower section 20 and then fixedly secure the lower section 20 at the desired angle. Preferably, the first pivoting mechanism 50 also utilizes a removable connecting pin 52 to fix the angle of the lower section 20 relative to the upper section 18 of bench 16.

Figure 6:
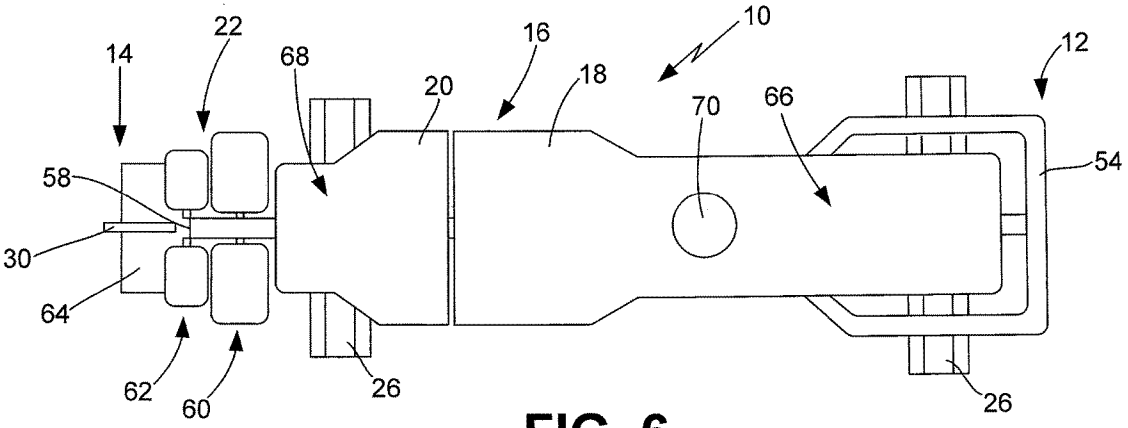
FIG. 6 is a top view of the core training bench of FIG. 5.
Figure 7A:
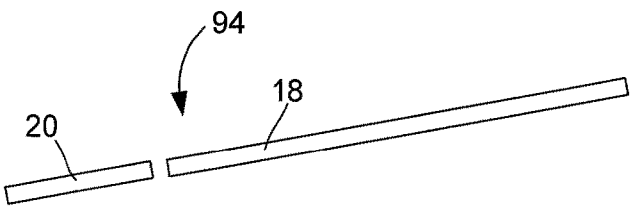
FIGS. 7*a*-7*d* illustrate the various tilting positions of the upper section and lower section of the bench that can be achieved using the core training bench of FIG. 5.
Figure 7B:
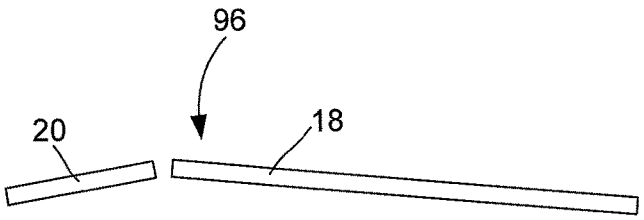
Figure 7C:
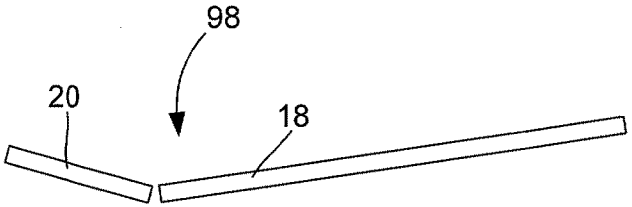
Figure 7D:
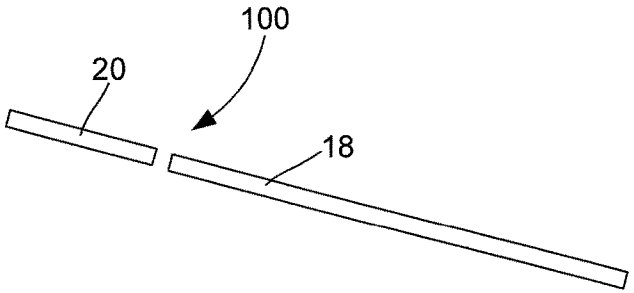

As stated above, in the preferred embodiment of the present invention, shown in FIGS. 5 through 7*d*, the upper section 18 of bench 16 is also configured to tilt or incline, in corresponding or contrasting relation to the incline angle of the lower section 20, as shown in FIGS. 7*a* through 7*d*. To achieve the desired tilting, the upper section 18 has a second pivoting mechanism 80 associated with upper section 18 and configured to incline upper section 18, as shown in FIGS. 7*a* and 7*c*, and decline upper section 18, as shown in FIGS. 7*b* and 7*d*. Second pivoting mechanism 80 should be configured to allow the user to quickly, easily and safely tilt the upper section 18 in the desired direction and then fixedly secure the upper section 18 in the desired inclination, which may be inclining, declining or horizontal. In one embodiment, the second pivoting mechanism 80 comprises a first upper swivel hinge 82 at the upper end of the first leg members 32 and a second upper swivel hinge 84 at the upper end of the second leg members 34, as best shown in FIG. 5. The first 82 and second 84 upper swivel hinges are configured to pivotally interconnect the upper end of leg members 32/34, respectively, to the upper section 18 of bench 16. Preferably, the second pivoting mechanism 80 also comprises a first lower swivel hinge 86 at the lower end of the first leg members 32 and a second lower swivel hinge 88 at the lower end of the second leg members 34, as best shown in FIG. 5. First 86 and second 88 lower swivel hinges are configured to pivotally interconnect the lower end of the leg members 32/34, respectively, to frame 24. To facilitate the user setting and fixing the desired angle of incline/decline for upper section 18, the preferred configuration also includes an incline/decline bracket 90 having a plurality of bracket apertures 91 that are each configured to receive a pull pin 92 cooperatively inserted though an aperture in first upper swivel hinge 82, as shown in FIG. 5.

As shown in FIGS. 7*a* through 7*d*, the upper section 18 and lower section 20 can, depending on the user's preferences, type of exercise and target muscles, be placed in a variety of different tilt positions. In FIG. 7*a*, the bench 16 is placed in first tilt position 94 where it inclines toward the head end 12 (the inclining position). In FIG. 7*b*, the bench 16 is placed in second tilt position 96, with both the upper section 18 and lower section 20 tilting downward from the junction (whether they actually abut or not) of the two sections 18/20. In FIG. 7*c*, the bench 16 is placed in third tilt position 98, with both the upper section 18 and lower section 20 tilting upward from the junction of the two sections 18/20. In FIG. 7*d*, the bench is placed in fourth tilt position 100 where it declines toward the head end 12 (the declining position). As stated above, the user of core training bench 10 of the present invention can selectively place the bench 16 in a horizontal position, such as shown in FIG. 5, any of the tilt positions 94, 96, 98 and 100 to achieve the user's exercises and exercise objectives. In a preferred embodiment, bench 16 will be able to be placed in an inclining position with an angle of approximately 45 degrees and be placed in a declining position with an angle of approximately 25 degrees. The pull pin 92 locks the incline/decline bracket 90 in the desired position. The swivel hinges 82, 84, 86 and 88 should be selected so as to allow the user to smoothly reposition the bench 16 to the desired angle. First leg members 32 and second leg members 34 will swivel to achieve the desired incline/decline setting.

As shown in FIGS. 1, 2, 5 and 6, fixedly attached at or near the head end 12 of core training bench 10 is a grip bar 54 that can be utilized by the user when he or she is laying on bench 16 to perform a variety of different exercises directed to the core area of his or her body. The grip bar 54 should extend outwardly from the head end of the upper bench 18 and be slightly raised above the level of the bench 16, as best shown in FIGS. 2, 3 and 6. The grip bar 54 must be sufficiently secured to upper bench 18 so the user can pull his or her weight against the grip bar 54 while performing exercises.

As stated above, in the preferred embodiment of the present invention the oblique stand 22 is removably attached to the portion of the core training bench 10 having bench 16. In a preferred configuration, a portion of the frame of the oblique stand 22 is slidably received in a portion of the frame of the bench 16, as best shown in FIGS. 1 and 5. A connecting pin 56 is utilized to allow the user to easily and quickly connect or disconnect the oblique stand 22 from the bench 16 of core training bench 10. In a preferred embodiment, oblique stand 22 comprises an upwardly disposed oblique frame 58 having a pair of upper leg pads 60 rotatably attached thereto and a pair of lower/ankle pads 62 rotatably attached thereto. The preferred oblique stand 22 also comprises a foot plate 64. The configuration and use of upper leg pads 60, lower/ankle pads 62 and foot plate 64 are generally well known in the art of exercise benches.

As well known in the art, frame 24, handle 30, leg members 32/34, lower leg member 42, first pivoting mechanism 50, second pivoting mechanism 80, grip bar 54 and oblique frame 58 can be manufactured out of steel or other strong metal. If desired, some of these components may be able to be manufactured out of various non-metal materials, particularly out of certain composite materials, to reduce the weight and, perhaps, the cost of core training bench 10. As also well known in the art, at least the upper surface of 66 of upper section 18 and the upper surface 68 of lower section 20 are covered with a vinyl (or other relatively soft material) covered padding for the comfort of the user as he or she lays on bench 16 when using core training bench 10. As shown in FIGS. 2 and 6, the size and configuration of the upper section 18 and lower section 20 can be selected so as to be a generally rectangular shape (FIG. 2) or various other modified shapes (e.g., FIG. 6) as desired by the manufacturers of core training bench 10. Preferably, grip bar 54 and leg pads 60/62 are covered with a non-slip material to improve the user's grip on grip bar 54 and to reduce the rotating of leg pads 60/62. All of the materials, particularly the cover materials described above, should be selected so as to provide a relatively long life for core training bench 10 when utilized in the intended manner. In a preferred embodiment of core training bench 10, the upper section 28 of bench 16 has a removable section 70, shown in FIGS. 2 and 6, that can be removed from upper section 18 to provide a cavity or hole which is sized and configured to removably receive an AB ball, which is well known in the art, therein to allow the user to improve the effectiveness and/or efficiency of his or her AB-related exercises. The various connecting pins 40, 48, 52 and 56 and pull pin 92 that are utilized with core training bench 10 must be manufactured out of metal or other materials which are sufficiently strong to withstand the forces that will be applied to these connecting mechanisms so as to fixedly secure the various components together as desired by the user.

Figure 8:
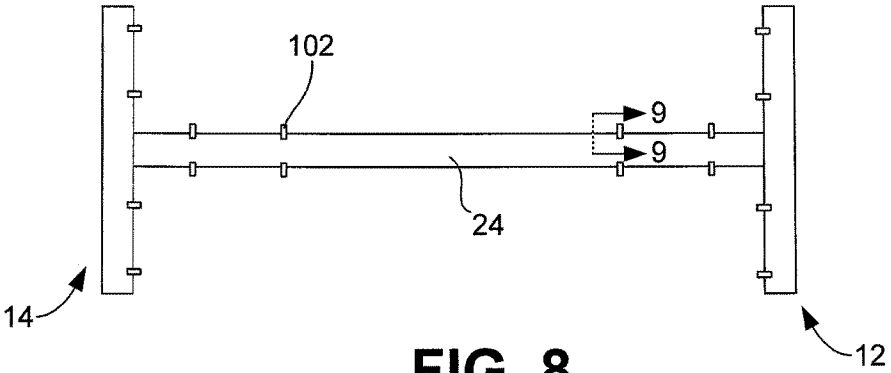
FIG. 8 is a top view of a preferred frame for use with the core training bench of the present invention showing tension cable hooks used therewith.
Figure 9:
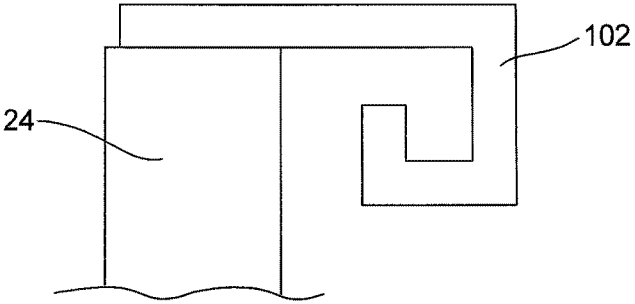
FIG. 9 is a sectional view of a portion of the frame of FIG. 8 taken through lines 9-9 of FIG. 8 showing a side view of a tension cable hook attached to the frame.

To further improve the versatility and usability of core training bench 10 of the present invention, a plurality of tension cable hooks 102 can be fixedly or removably attached to frame 24, such as shown in FIGS. 8 and 9. The tension cable hooks 102 are placed in spaced apart relation along frame 24 and are configured for use with rubber tension cables (not shown) for use a weight training workout. The locations of the tension cable hooks 102 and the configuration thereof shown in FIGS. 8 and 9 are for exemplary purposes only. As will be readily apparent to those skilled in the art, a wide variety of locations along frame 24 can be suitable for attachment of tension cable hooks 102 and the hooks 102 can have a different shape than that shown in FIG. 9.

Figure 10:
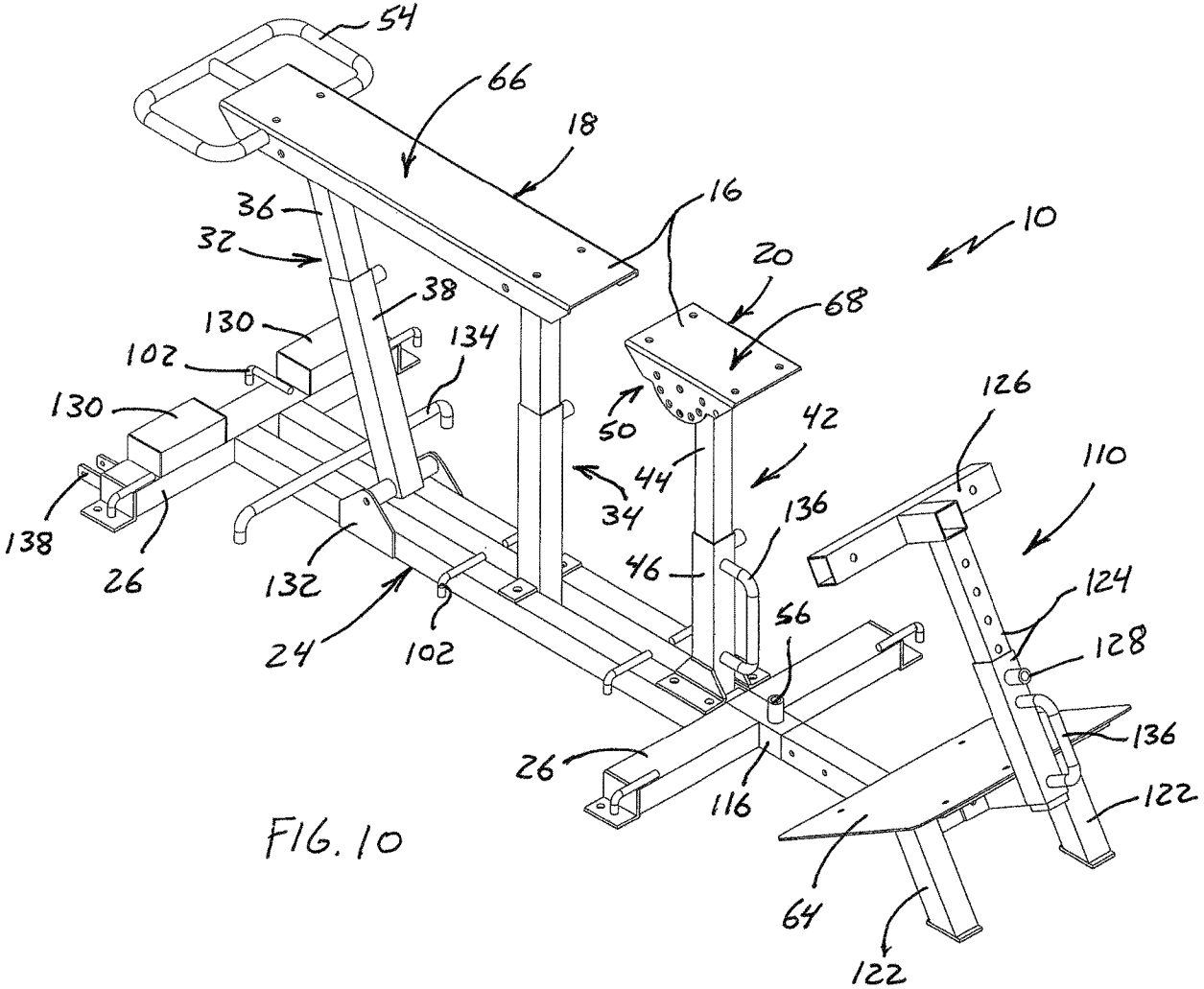
FIG. 10 is a side perspective view of a core training bench configured according to a third embodiment of the present invention showing use of a hyper extension and oblique attachment at the foot end of the core training bench, with the core training bench shown without the use of any padding material.
Figure 11:
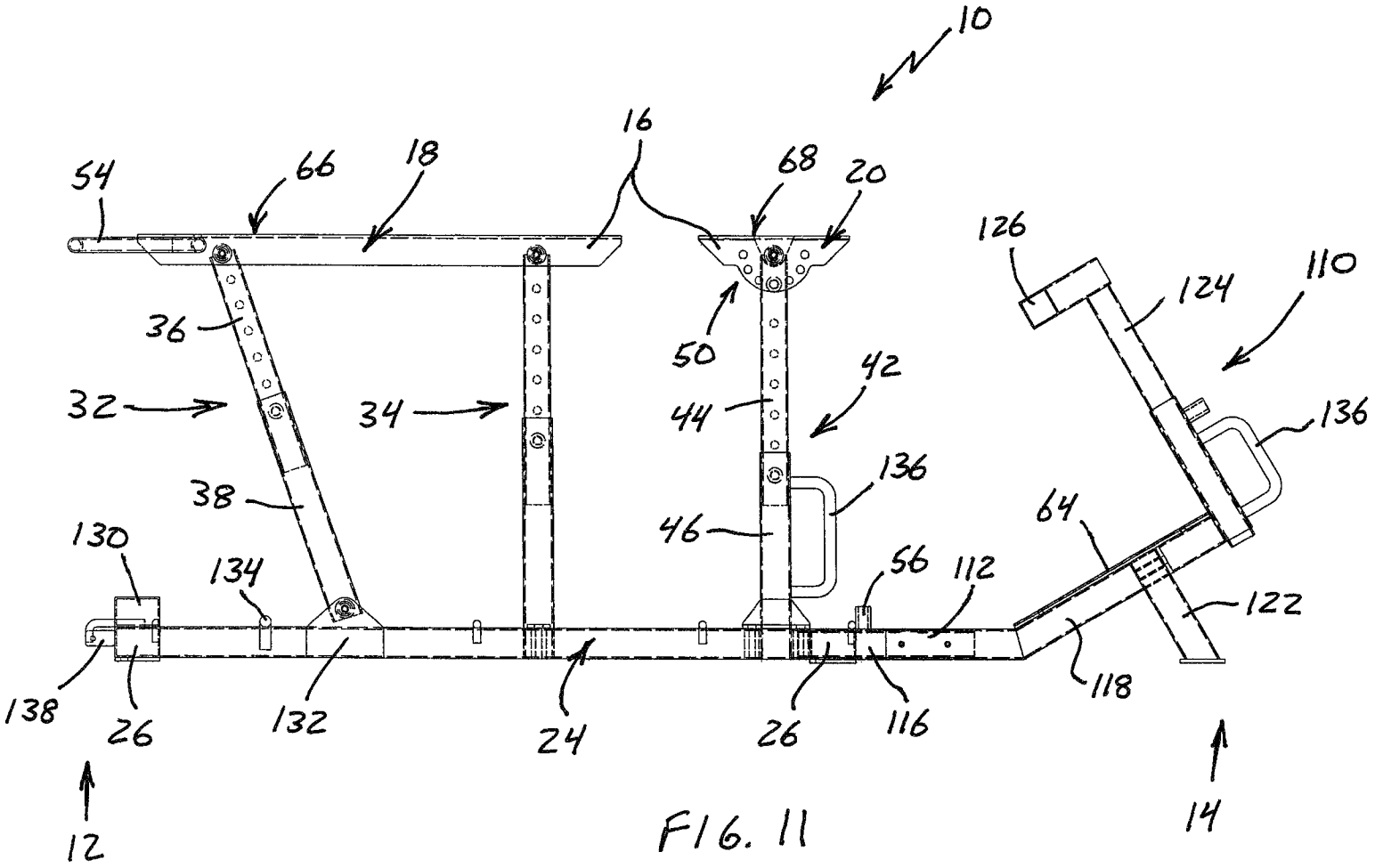
FIG. 11 is a side view of the core training bench of FIG. 10.
Figure 12:
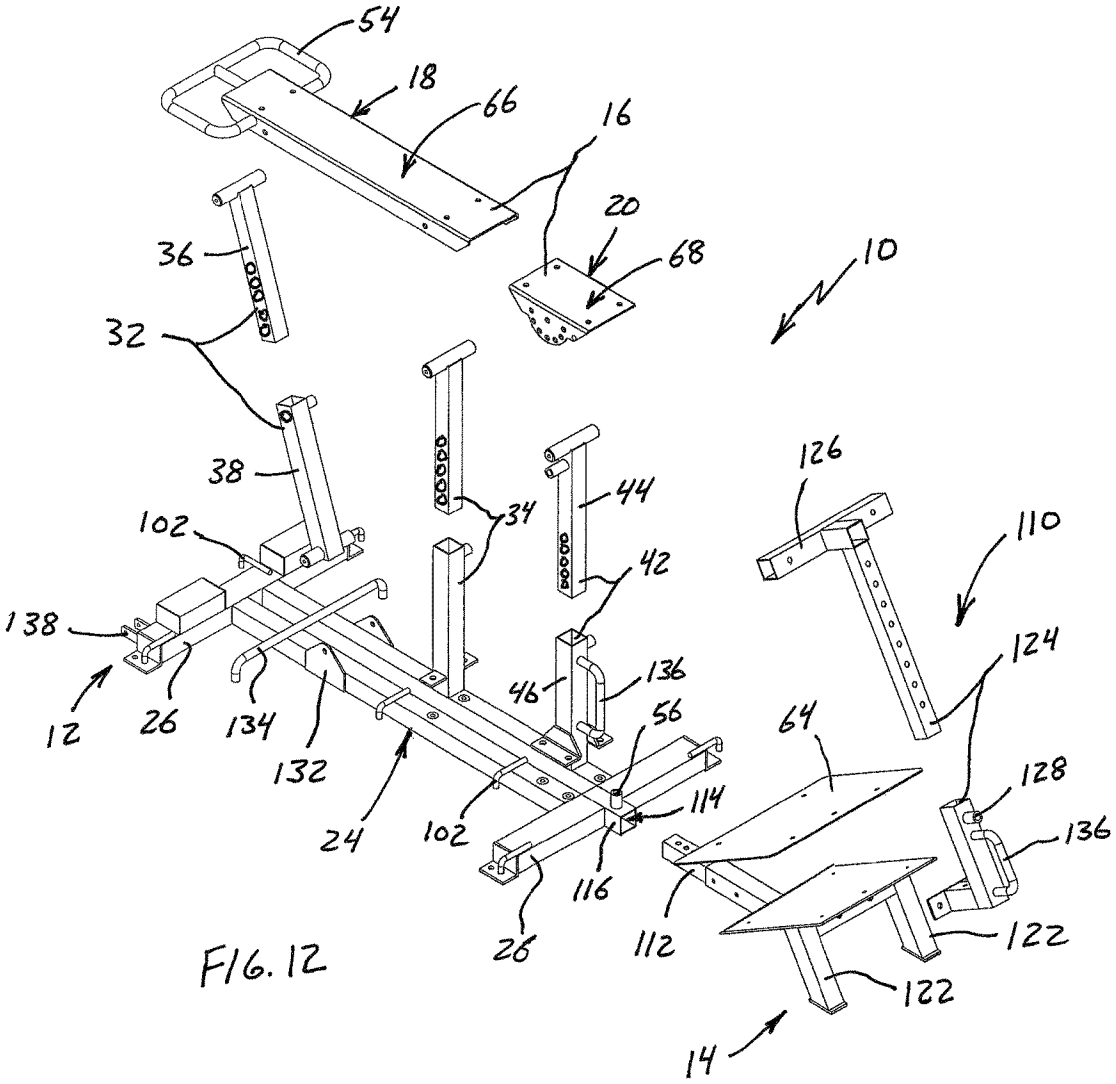
FIG. 12 is an exploded side perspective view of the core training bench of FIG. 10.
Figure 13:
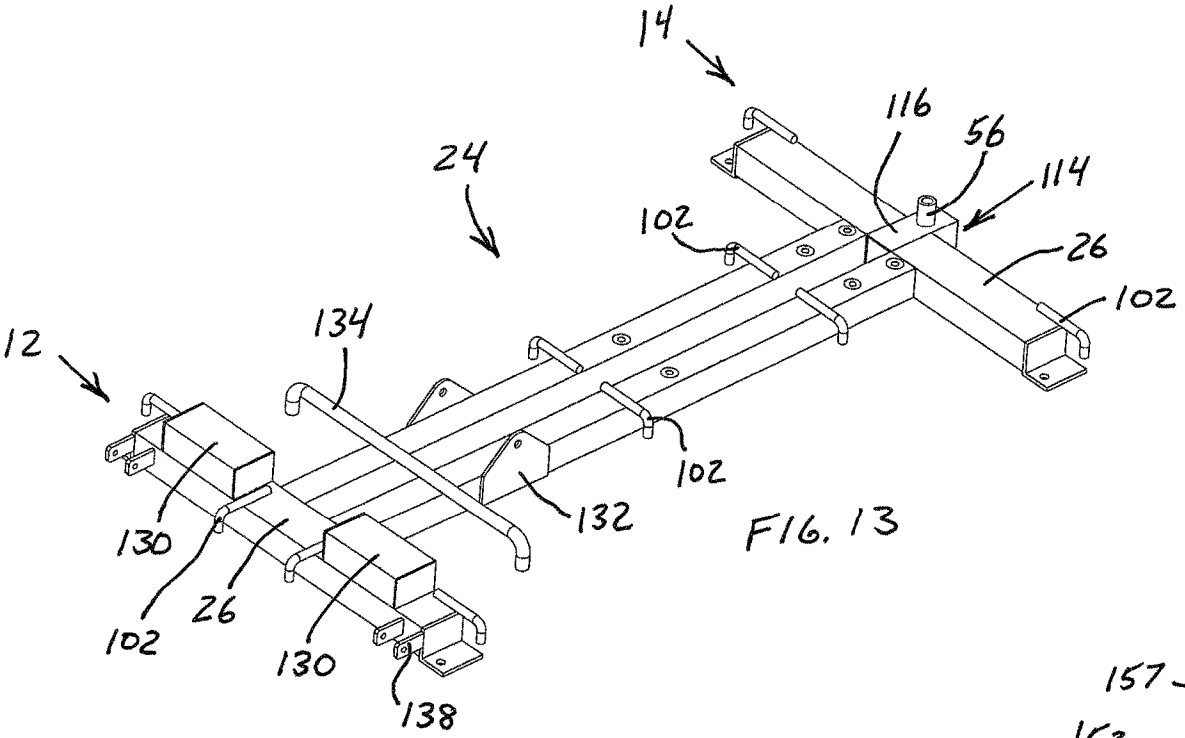
FIG. 13 is side perspective view of the base frame of the core training bench of FIG. 10.

A third embodiment of the core training bench 10 of the present invention is shown in FIGS. 10-13. In this embodiment, the core training bench 10 has a hyper extension and oblique attachment, shown as 110, removably attached at the foot end 14 thereof. In the embodiment shown in FIGS. 10-12, a horizontally disposed insert section 112 of the hyper extension and oblique attachment 110 is removably received into an open end 114 of base frame member 116 of the base frame 24. In a preferred configuration, insert section 112 of the hyper extension and oblique attachment 110 is slidably received in the open end 114 of the base frame 24 which supports bench 16, as best shown in FIGS. 10-12. A connecting pin 56 is utilized to allow the user to easily and quickly connect or disconnect the hyper extension and oblique attachment 110 from the base frame 24 of the core training bench 10. The position of the hyper extension and oblique attachment 110 relative to the base frame 24 is selected by the user by how far in or out he or she places the insert section 112. The user can utilize the hyper extension and oblique attachment 110 to perform a variety of oblique exercises, including such common and well known exercises such as inclined sit-ups and the like.

In a preferred configuration, such as shown in FIGS. 10-12, the hyper extension and oblique attachment 110 comprises an upwardly angled oblique frame member 118 having a foot plate 64 attached thereto so as to be generally directed toward the bench 16, with the oblique frame member 118 and foot plate 64 being supported by a pair of support legs 122. Fixedly attached to the oblique frame member 118 is a telescopically configured foot frame member 124 that fixedly supports foot cross member 126 at the upper end thereof. As will be readily appreciated by persons skilled in the art, the foot cross member 126 will be covered by a pad or padding material and the user adjusts the positioning of the of the foot cross member 126 by telescopically adjusting the foot frame member 124. A connecting pin 128 fixes the height of the telescopically configured foot frame member 124 for the convenience and benefit of the user.

As well known in the art, at least the base frame 24, leg members 32/34, lower leg member 42, first pivoting mechanism 50, grip bar 54, and the frame/leg members of the hyper extension and oblique attachment 110 should be manufactured out of steel or other strong metal. Typically, the foot plate 64 will be made out of aluminum or the like. If desired, some of these components may be able to be manufactured out of various non-metal materials, particularly out of certain composite materials, to reduce the weight and, perhaps, the cost of core training bench 10. As also well known in the art, at least the upper surface of 66 of upper section 18 and the upper surface 68 of lower section 20 are covered with a vinyl (or other relatively soft material) covered padding for the comfort of the user as he or she lays on bench 16 when using core training bench 10. Preferably, grip bar 54 and leg pads 60/62 are covered with a non-slip material to improve the user's grip on grip bar 54. All of the materials, particularly the cover materials described above, should be selected so as to provide a relatively long life for core the training bench 10 when utilized in the intended manner. In a preferred embodiment of core training bench 10, the upper section 28 of bench 16 has a removable section 70, shown in FIGS. 2 and 6, that can be removed from upper section 18 to provide a cavity or hole which is sized and configured to removably receive an AB ball, which are well known in the art of exercise and equipment used for exercise, therein to allow the user to improve the effectiveness and/or efficiency of his or her AB-related exercises. The various connecting pins 40, 48, 52, 56 and 128 utilized with core training bench 10 must be manufactured out of metal or other materials which are sufficiently strong to withstand the forces that will be applied to these connecting mechanisms so as to fixedly secure the various components together as desired by the user.

As with the embodiments described above, the core training bench 10 of the embodiment shown in FIGS. 10-12 has a plurality of tension cable hooks 102 which the user can utilize with weight resistance bands, which are well known to persons in the art, to provide strength resistance exercise. The tension cable hooks 102 can be placed at a variety of beneficial locations on the core training bench 10 (such as those positions shown in the drawings). This embodiment also includes a pair of calf raise blocks 130 at the head end 12 of the core training bench 10. The user can utilized these blocks to perform calf exercises while steadying himself or her self by holding on to the bench 16 and or the grip bar 54. To help the user with such exercises, the first leg member 32 is telescopically configured, disposed at an angle toward the head end 12 and pivotally attached to a pivot plate 132 that is attached to base frame 24. The inclined first leg member 32 also allows the user to arrange the upper section 18 of bench 16 to perform exercises such as the inclined bench press so he or she may exercise the upper portion of his or her chest, as well as perform other exercises. This embodiment also shows use of transverse bar 134 that is positioned generally near the head end 12 of the core training bench 10 in a transverse relation to the base frame 24. The transverse bar 134 can be utilized for resistance bands and for doing certain exercises, such as a military press position, where the user can place his or her feet under the transverse bar for stability purposes while leaning sitting on the upper section 18 of the bench and leaning against the pivoted lower section 20 of the bench (i.e., with the two bench sections generally forming a chair-like configuration). This embodiment also shows use of handles 136 that the user can utilize to help him or her move the core training bench 10, with or without the hyper extension and oblique attachment 110 attached thereto, from a storage location to a location beneficial for use. To further assist the user with moving core training bench 10, wheels can attach to wheel mounts 138 at or near the head end 12 thereof, such as the base member 26 at the head end 12.

Figure 14:
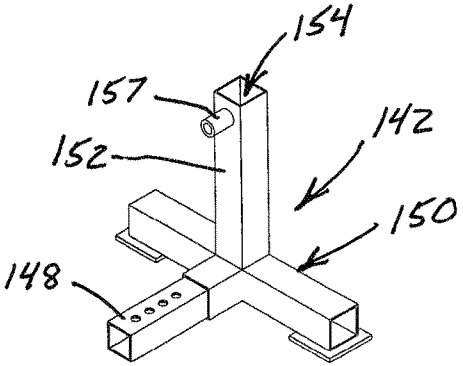
FIG. 14 is a side perspective view of a horizontal connecting section of a leg attachment that connects to the base frame of FIG. 13 and which is utilized with the core training bench of the present invention shown in FIG. 10 in place of the hyper extension and oblique attachment.
Figure 16:
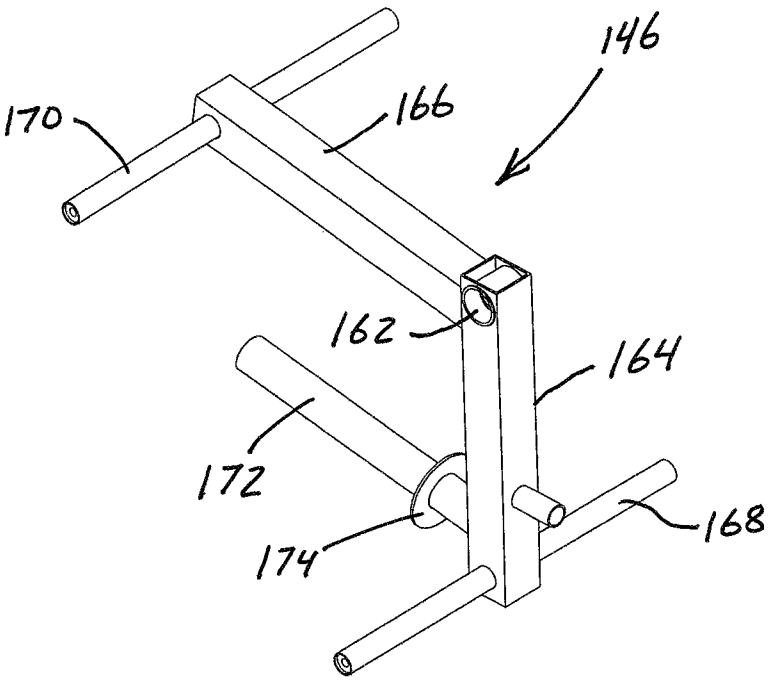
FIG. 16 is a side perspective view of a pivotal section of the leg attachment that connects to the vertical connecting section of FIG. 15.
Figure 15:
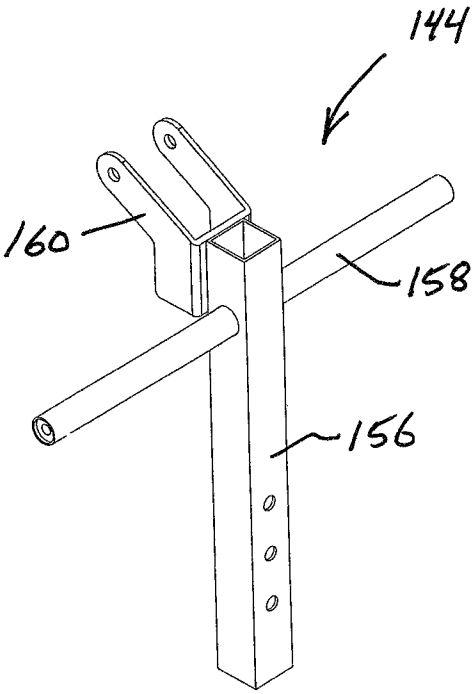
FIG. 15 is a side perspective view of a vertical connecting section of the leg attachment that connects to the horizontal connection section of FIG. 14.

The core training bench 10 of the present invention can also be utilized with a leg attachment, referred to as 140 and comprising collectively the horizontal connecting section 142 (FIG. 14), the vertical connecting section 144 (FIG. 15) and the pivotal section 146 (FIG. 16). As set forth below, these sections 142/144/146 connect together to form the leg attachment 140 for the core training bench 10. The horizontal connecting section 142 comprises an insert member 148 that is received inside the open end 114 of the base frame member 116 of the base frame 24 and connected thereto. The insert member 148 of the horizontal connecting section 142 connects to a horizontal base 150 having an upwardly disposed vertical post 152 having an open end 154 at the top thereof. The open end 154 of the vertical post 152 is sized and configured to receive a cooperatively configured downwardly disposed vertical post 156 of the vertical connecting section 144. A connecting pin 157 interconnects the vertical posts 152/156. At or near the upper end of the vertical connecting section 144 is positioned a generally round bar 158 (which may or may not be tubular) and an outwardly disposed pivot bracket 160. The round bar 158 is utilized by the user to during exercise to pivot the weights discussed below. The pivot bracket 160 pivotally connects to the pivotal section 146 at the pivot aperture 162, through which a bolt or other member (not shown) is utilized to pivotally connect the pivot bracket 160 to the pivot aperture 162. Extending downward from the pivot aperture 162 is vertical support member 164 and extending outward from pivot aperture 162 is a generally horizontal support member 166. At the lower end of the vertical support member 164 is placed a round bar 168. At the outer end of the horizontal support member 166 is also placed a round bar 170. The round bars 168/170 are utilized by the user to lift the weights supported by the leg attachment 140. The weights for leg attachment 140 are supported on an outwardly extending support post 172 that extends away from the vertical support member 164. Weights having a center aperture, which are well known in the art, are placed on the support post 172. A stop member 174 prevents the weights from sliding backwards against the user while he or she uses the leg attachment to exercise and strengthen his or her legs. To use the leg attachment 140, it is first attached to the base frame 24 by inserting the insert member 148 into the open end 114 and securing the two components together with the connecting pin 56. The vertical post 156 is then inserted in the vertical post 152 and the two are secured together with connecting pin 157. The pivot aperture 162 is positioned in the pivot bracket 160 and the bolt is inserted therethrough to connect the pivot section 146 to the vertical connecting section 144.

In use, a person using core training bench 10 will be able to perform a variety of core area specific exercises by utilizing the components of the present invention and by adjusting these components to suit their size and the exercise to be performed. Because of the adjustability of the components, the user will be able to better focus on the target areas of their core area that he or she needs to improve so as to be more fit, providing a much more effective and efficient workout. In addition, the adjustability of the components make the core training bench 10 more comfortable to use, which will likely increase the user's use of the present invention. As set forth above, the components are easy to adjust or connect using the various connecting pins 40, 48, 52, 56 and 92. If desired, the lower section 20 can be placed in an aligned position with upper section 18 to provide a bench 16 that is substantially planar and the user can utilize the core training bench 10 of the present invention as a standard or conventional exercise bench. In the preferred use, however, the core training bench 10 is specifically utilized to exercise the abdominal area, lower back and oblique muscles of the user so as to improve his or her core area fitness. In addition, in the preferred embodiment of FIG. 5 the user can change the tilt relationship between the upper section 18 and the lower section 20 to achieve a generally planar/horizontal position and any one of the tilt positions 94, 96, 98 and 100 to help the user more effectively and efficiently achieve his or her desired fitness results.

While there are shown and described herein a specific form of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to any dimensional relationships set forth herein and modifications in assembly, materials, size, shape and use. For instance, there are numerous components described herein that can be replaced with equivalent functioning components to accomplish the objectives of the present invention.

What is claimed is:

1. A core training bench, comprising:

a bench having a first section generally toward a head end of said core training bench and a second section generally toward a foot end thereof;

a removable section in said first section, said removable section sized and configured to removably receive a ball therein;

a frame;

a plurality of leg members interconnecting said frame and said bench so as to dispose said bench in spaced apart relation above said frame, said plurality of leg members comprising at least a first leg member, a second leg member and a lower leg member, each of said first leg member and said second leg member interconnecting said first section and said frame, said lower leg member interconnecting said second section and said frame; and first pivoting means interconnecting said lower leg member and said second section for pivoting said second section relative to said lower leg member, said first pivoting means configured to tilt said second section independent of said first section.

2. The core training bench of claim 1 further comprising second pivoting means interconnecting said first leg member and said first section and/or said frame and interconnecting said second leg member and said first section and/or said frame for pivoting said first section relative to each of said first leg member and said second leg member, said second pivoting means configured to tilt said first section independent of said second section.

3. The core training bench of claim 2, wherein said first section and said second section of said bench are able to independently tilt into a plurality of tilt positions.

4. The core training bench of claim 2, wherein said second pivoting means comprises at least one swivel hinge at each of said first leg member and said second leg member, each of said swivel hinges configured to allow said first section to pivot relative to said first leg member and said second leg member and/or to allow said first leg member and said second leg member to tilt relative to said frame.

5. The core training bench of claim 4, wherein said second pivoting means comprises a first upper swivel hinge interconnecting said first leg member and said first section, a second upper swivel hinge interconnecting said second leg member and said first section, a first lower swivel hinge interconnecting said first leg member and said frame and a second lower swivel hinge interconnecting said second leg member and said frame.

6. The core training bench of claim 1 further comprising an oblique stand removably attached to said frame generally at said foot end of said core training bench.

7. The core training bench of claim 1, wherein each of said first leg member and said second leg member are telescopically configured with a first leg section slidably received inside a second leg section and said lower leg member is telescopically configured with a first leg section of said lower leg member slidably received inside a second leg section of said lower leg member.

8. The core training bench of claim 1 further comprising a plurality of tension cable hooks attached to said frame.

9. The core training bench of claim 1 further comprising a grip bar connected to said first section generally at said head end of said core training bench.

10. The core training bench of claim 1 further comprising an oblique stand removably attached to said frame generally at said foot end of said core training bench and a plurality of tension cable hooks attached to said frame.

11. A core training bench, comprising:

a bench having a first section generally toward a head end of said core training bench and a second section generally toward a foot end thereof;

a removable section in said first section, said removable section sized and configured to removably receive a ball therein;

a frame;

a plurality of leg members interconnecting said frame and said bench so as to dispose said bench in spaced apart relation above said frame, said plurality of leg members comprising at least a first leg member, a second leg member and a lower leg member, each of said first leg member and said second leg member interconnecting said first section and said frame, said lower leg member interconnecting said second section and said frame, each of said first leg member and said second leg member being telescopically configured with a first leg section slidably received inside a second leg section and said lower leg member being telescopically configured with a first leg section of said lower leg member slidably received inside a second leg section of said lower leg member;

first pivoting means interconnecting said lower leg member and said second section for pivoting said second section relative to said lower leg member, said first pivoting means configured to tilt said second section independent of said first section; and second pivoting means interconnecting said first leg member and said first section and/or said frame and interconnecting said second leg member and said first section and/or said frame for pivoting said first section relative to each of said first leg member and said second leg member, said second pivoting means configured to tilt said first section independent of said second section, wherein said first section and said second section of said bench are able to independently tilt into a plurality of tilt positions.

12. The core training bench of claim 11, wherein said second pivoting means comprises at least one swivel hinge at each of said first leg member and said second leg member, each of said swivel hinges configured to allow said first section to pivot relative to said first leg member and said second leg member and/or to allow said first leg member and said second leg member to tilt relative to said frame.

13. The core training bench of claim 12, wherein said second pivoting means comprises a first upper swivel hinge interconnecting said first leg member and said first section, a second upper swivel hinge interconnecting said second leg member and said first section, a first lower swivel hinge interconnecting said first leg member and said frame and a second lower swivel hinge interconnecting said second leg member and said frame.

14. The core training bench of claim 11 further comprising an oblique stand removably attached to said frame generally at said foot end of said core training bench.

15. The core training bench of claim 11 further comprising a plurality of tension cable hooks attached to said frame.

16. The core training bench of claim 11 further comprising a grip bar connected to said first section generally at said head end of said core training bench.

17. The core training bench of claim 16 further comprising an oblique stand removably attached to said frame generally at said foot end of said core training bench and a plurality of tension cable hooks attached to said frame.

18. A core training bench, comprising:

a bench having a first section generally toward a head end of said core training bench and a second section generally toward a foot end thereof;

a frame;

a plurality of leg members interconnecting said frame and said bench so as to dispose said bench in spaced apart relation above said frame, said plurality of leg members comprising at least a first leg member, a second leg member and a lower leg member, each of said first leg member and said second leg member interconnecting said first section and said frame, said lower leg member interconnecting said second section and said frame;

first pivoting means interconnecting said lower leg member and said second section for pivoting said second section relative to said lower leg member, said first pivoting means configured to tilt said second section independent of said first section; and second pivoting means interconnecting said first leg member and said first section and/or said frame and interconnecting said second leg member and said first section and/or said frame for pivoting said first section relative to each of said first leg member and said second leg member, said second pivoting means configured to tilt said first section independent of said second section, wherein said second pivoting means comprises a first upper swivel hinge interconnecting said first leg member and said first section, a second upper swivel hinge interconnecting said second leg member and said first section, a first lower swivel hinge interconnecting said first leg member and said frame and a second lower swivel hinge interconnecting said second leg member and said frame, said first upper swivel hinge and said second upper swivel being configured to allow said first section to pivot relative to said first leg member and said second leg member, said first lower swivel hinge and said second lower swivel being configured to allow said first leg member and said second leg member to tilt relative to said frame.

* * * * *